US011352918B1

(12) United States Patent
Peila

(10) Patent No.: US 11,352,918 B1
(45) Date of Patent: Jun. 7, 2022

(54) VARIABLE VALVE TIMING METHOD AND MECHANISM

(71) Applicant: Anthony John Peila, Greensburg, PA (US)

(72) Inventor: Anthony John Peila, Greensburg, PA (US)

( * ) Notice: Subject to any disclaimer, the term of this patent is extended or adjusted under 35 U.S.C. 154(b) by 0 days.

(21) Appl. No.: 17/180,722

(22) Filed: Feb. 20, 2021

(51) Int. Cl.

| | |
|---|---|
| ***F01L 1/348*** | (2006.01) |
| ***F01L 1/02*** | (2006.01) |
| ***F01L 1/46*** | (2006.01) |
| *F01L 13/00* | (2006.01) |
| *F01L 1/053* | (2006.01) |

(52) U.S. Cl.
CPC ..... *F01L 1/348* (2013.01); *F01L 1/024* (2013.01); *F01L 1/46* (2013.01); *F01L 1/053* (2013.01); *F01L 2013/10* (2013.01); *F01L 2013/103* (2013.01); *F01L 2013/106* (2013.01); *F01L 2201/00* (2013.01); *F01L 2250/04* (2013.01); *F01L 2305/00* (2020.05)

(58) Field of Classification Search
CPC . F01L 1/024; F01L 1/053; F01L 1/348; F01L 1/46; F01L 2013/10; F01L 2013/103; F01L 2013/106; F01L 2201/00; F01L 2250/04
USPC ..... 123/90.15, 90.31
See application file for complete search history.

(56) References Cited

U.S. PATENT DOCUMENTS

| | | | | |
|---|---|---|---|---|
| 3,441,009 A * | 4/1969 | Rafanelli | F02B 67/06 | 123/90.15 |
| 3,496,918 A * | 2/1970 | Finlay | F01L 1/348 | 474/900 |
| 3,888,217 A * | 6/1975 | Hisserich | F02D 13/0265 | 123/90.31 |
| 4,723,516 A * | 2/1988 | Slagley | F01L 1/348 | 123/90.39 |
| 4,890,589 A * | 1/1990 | Miyate | F16H 21/20 | 123/197.1 |
| 7,228,829 B1 * | 6/2007 | Louie | F01L 1/024 | 123/90.31 |

* cited by examiner

*Primary Examiner* — Jorge L Leon, Jr.

(57) ABSTRACT

This invention describes a variable valve timing mechanism which may be fitted to an internal combustion engine to provide precise control over timing of the valve opening and closing events of the camshaft relative to the crankshaft. Various methods for its application are described to provide settable valve timing at either predetermined angle selected by the operator, or automatic variable valve timing as governed by parameters of the operating engine. Said mechanism comprised of oppositely located idler rollers, whereas not bound to a single yoke or carrier, are driven by a cam to achieve independent movement of the rollers, which bear against both tension and slack sides of the belt between the crankshaft and camshaft pulleys causing predictable and repeatable variation in valve timing. Thus, this invention, whereby coordinated but non-uniform movements of the idler rollers is achieved by the mechanical appurtenances described herein, including a specially developed cardioid cam to actuate said idler rollers, produces precise changes in camshaft phase angle.

12 Claims, 12 Drawing Sheets

Mechanism for Causing Camshaft Phase Angle Changes

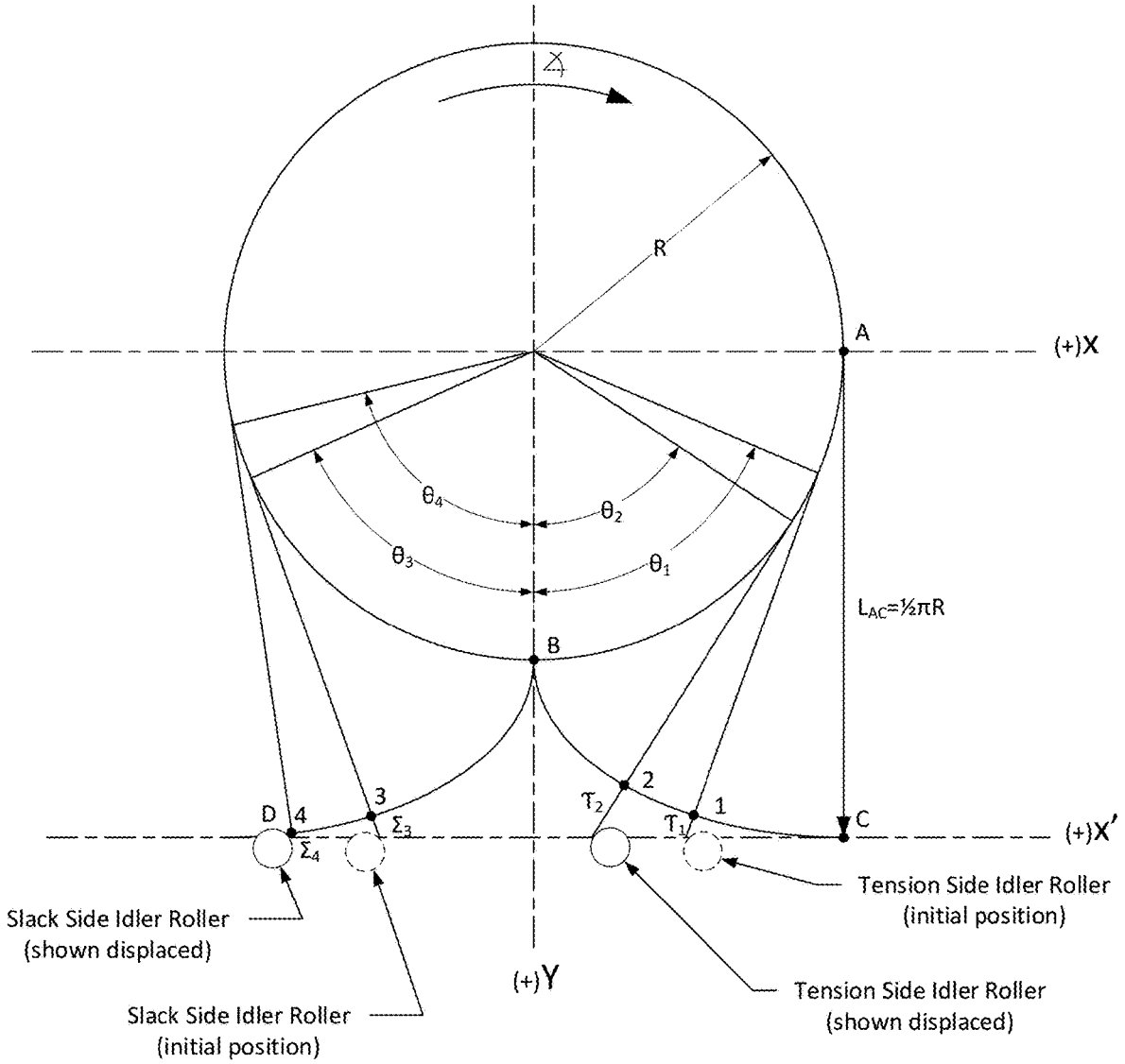
*Figure 1* – Camshaft Drive Diagram

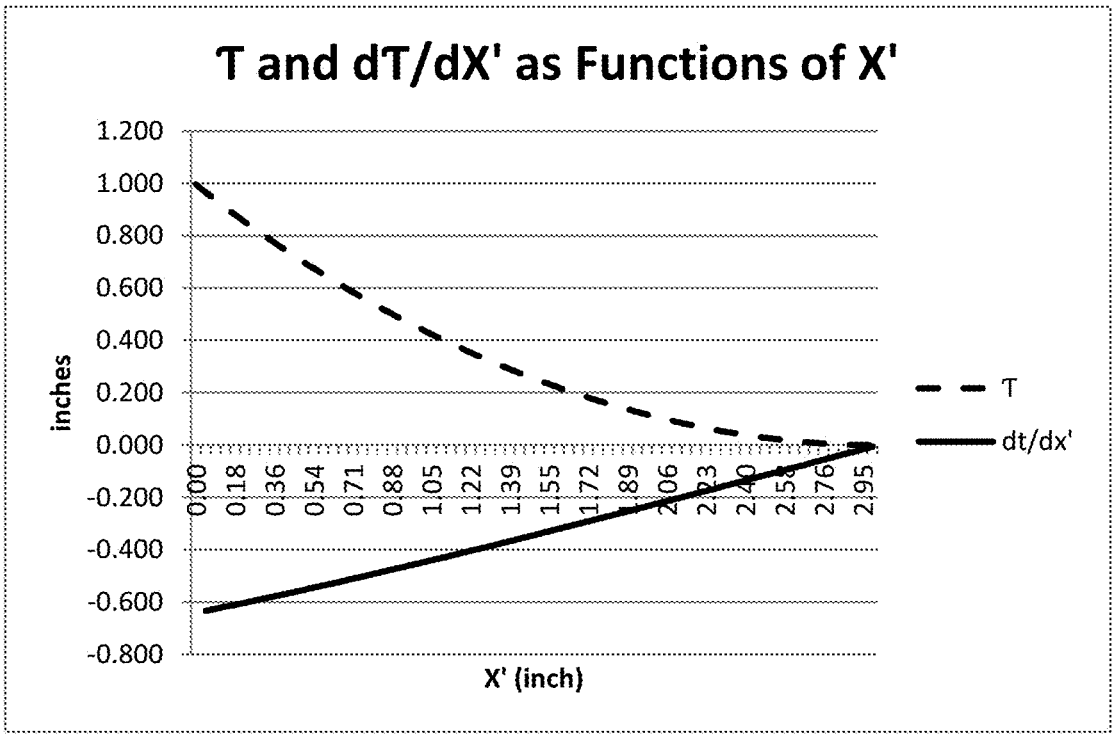
*Figure 2* – Plot of $T_{X'}$ and its First Derivative

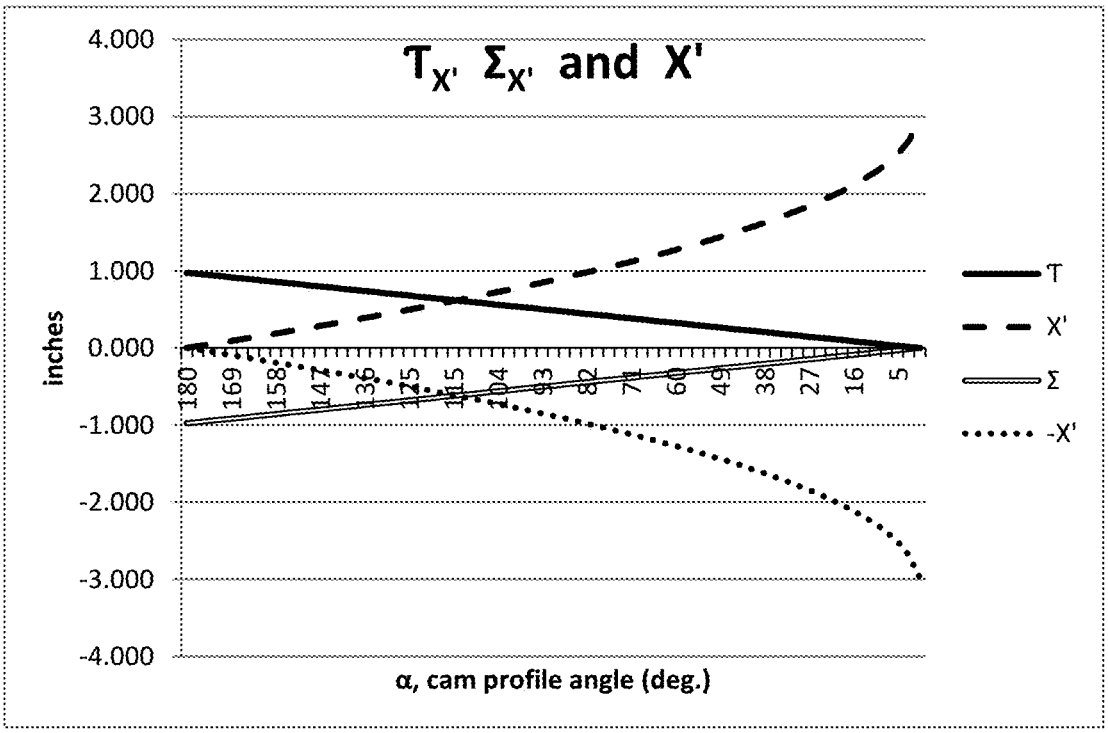
*Figure 3* – Plot of $T_{X'}$, $\Sigma_{X'}$, and X' with Alpha

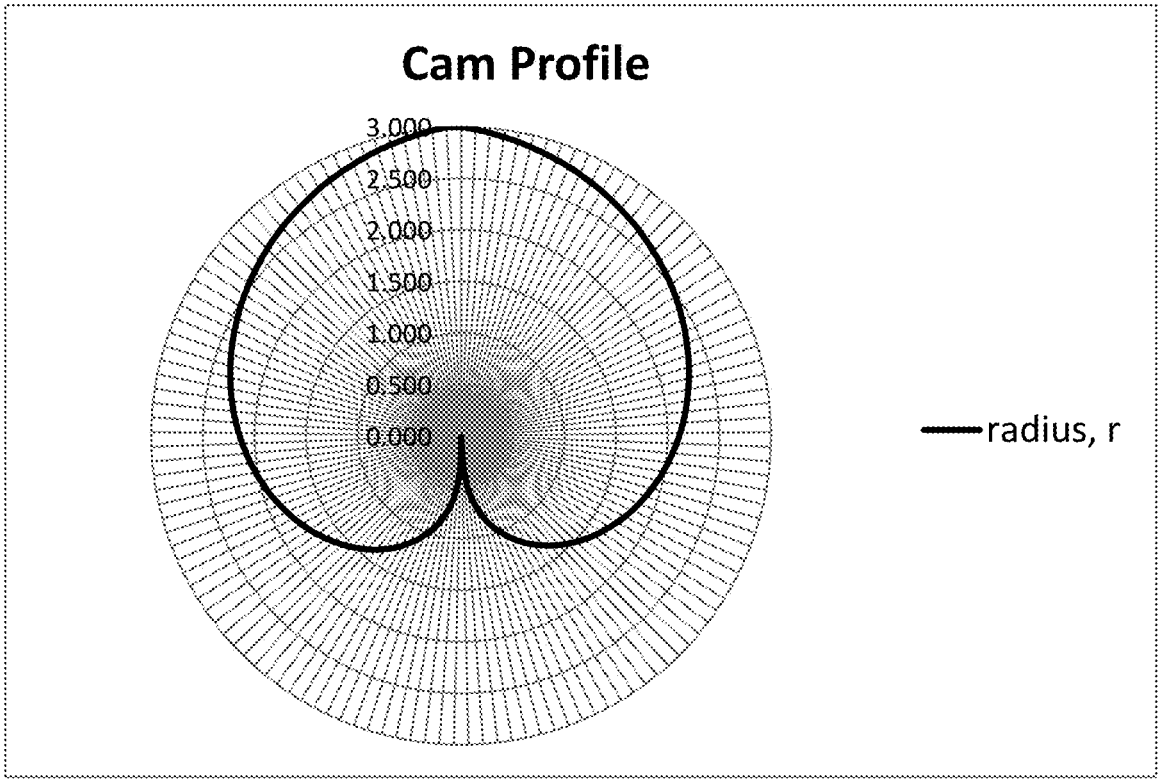
*Figure 4* – Plot of polar coordinates r with alpha

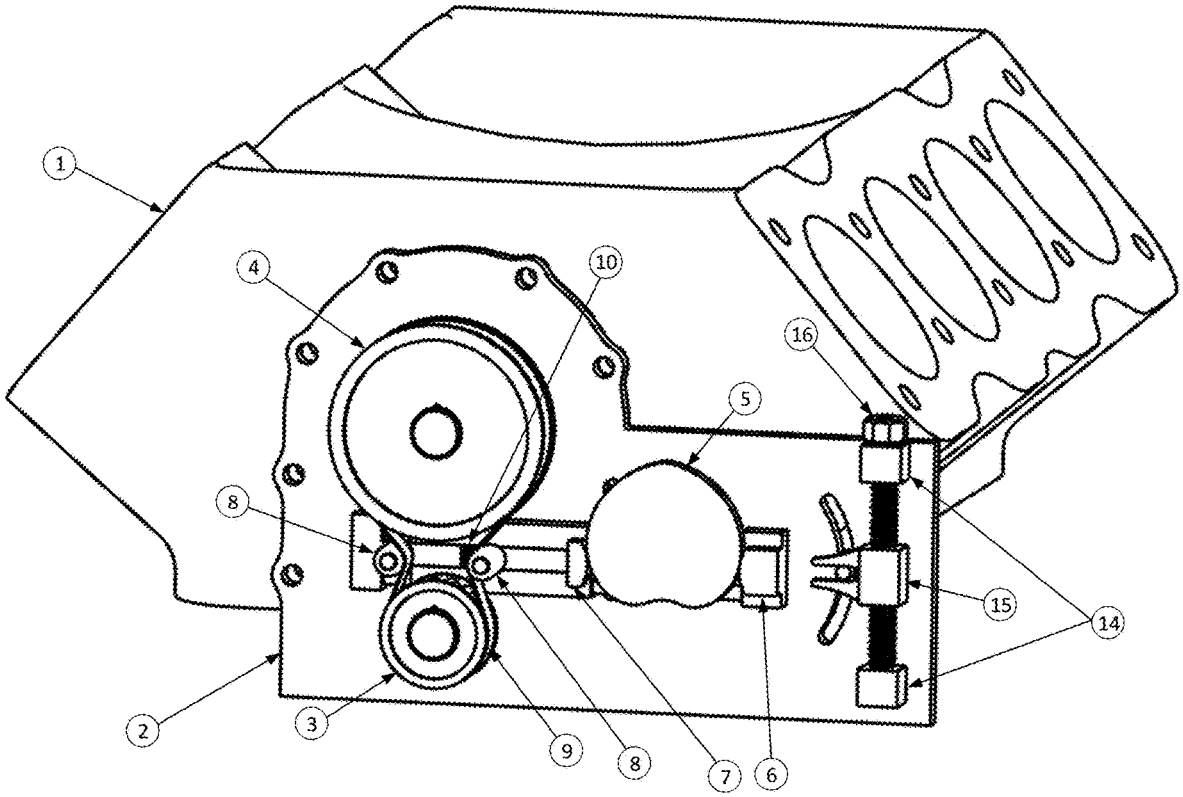
*Figure 5* – Mechanism for Causing Camshaft Phase Angle Changes

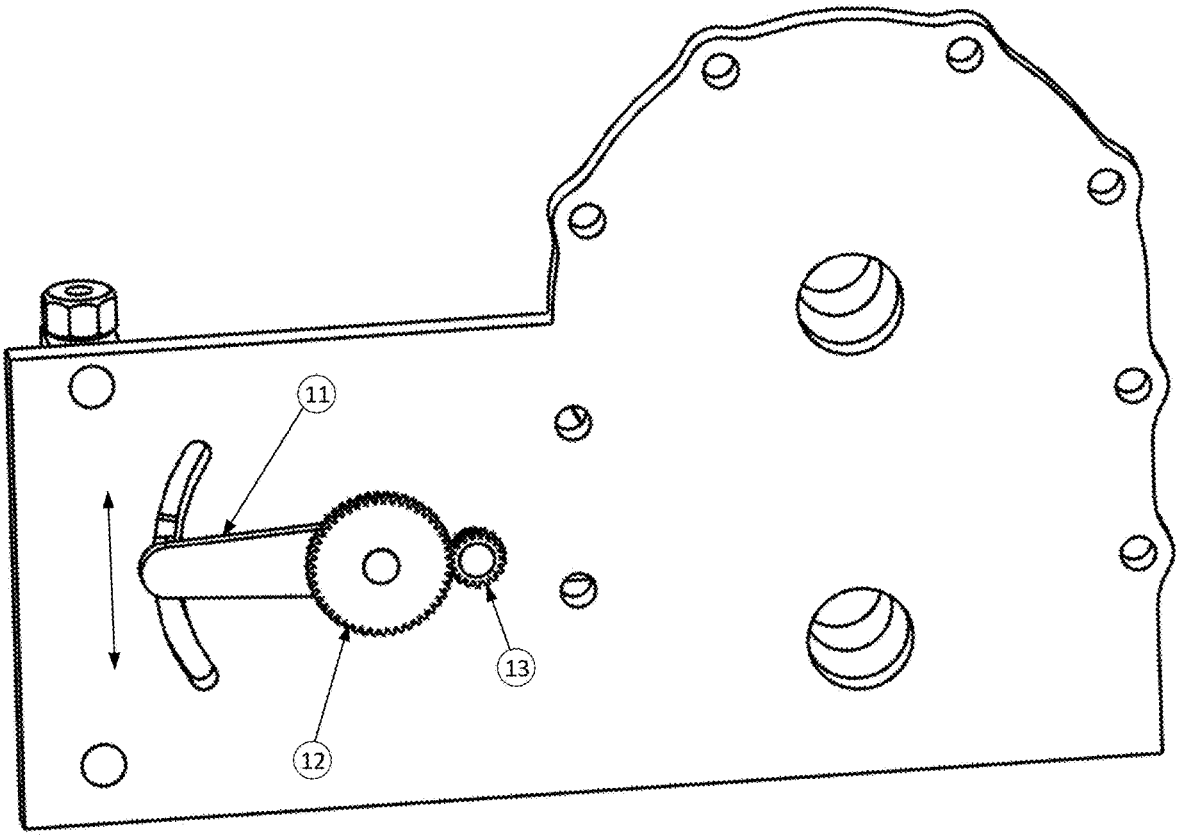
*Figure 6* – Rear View Showing Cam Actuator Lever and Gears

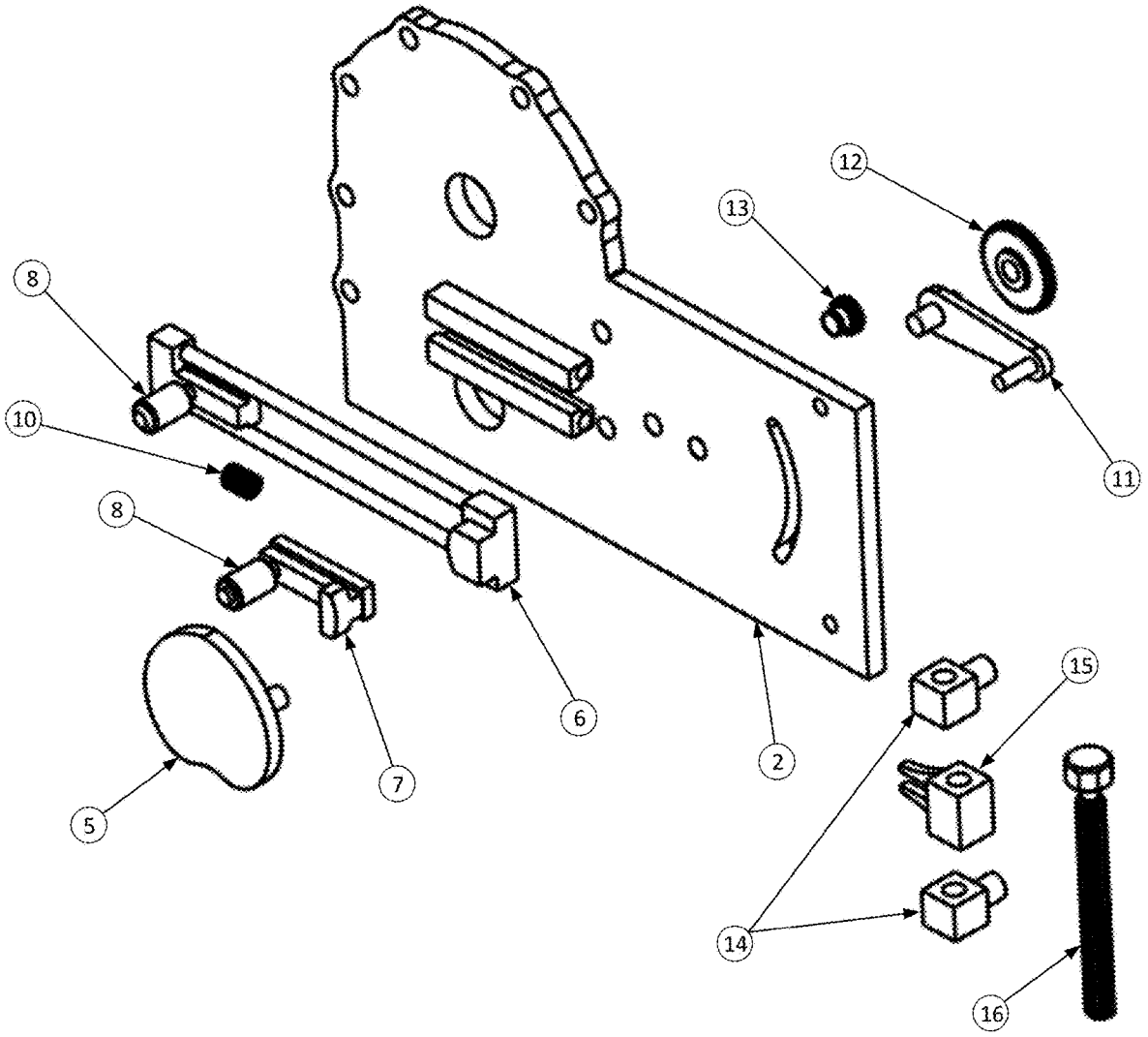
*Figure 7* – Exploded View of Mechanism

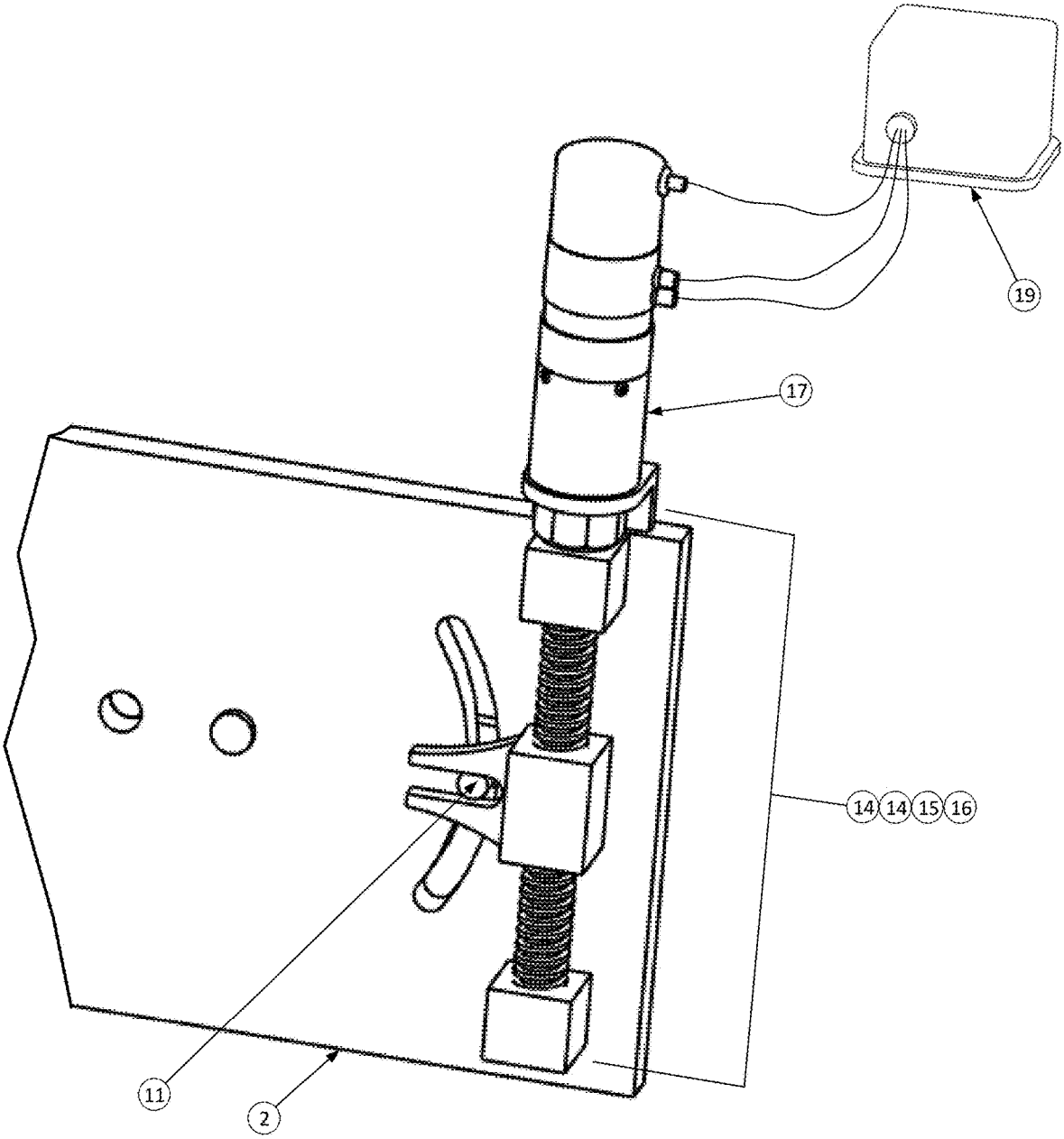
*Figure 8* – Automatic Rotary Activation of the Mechanism

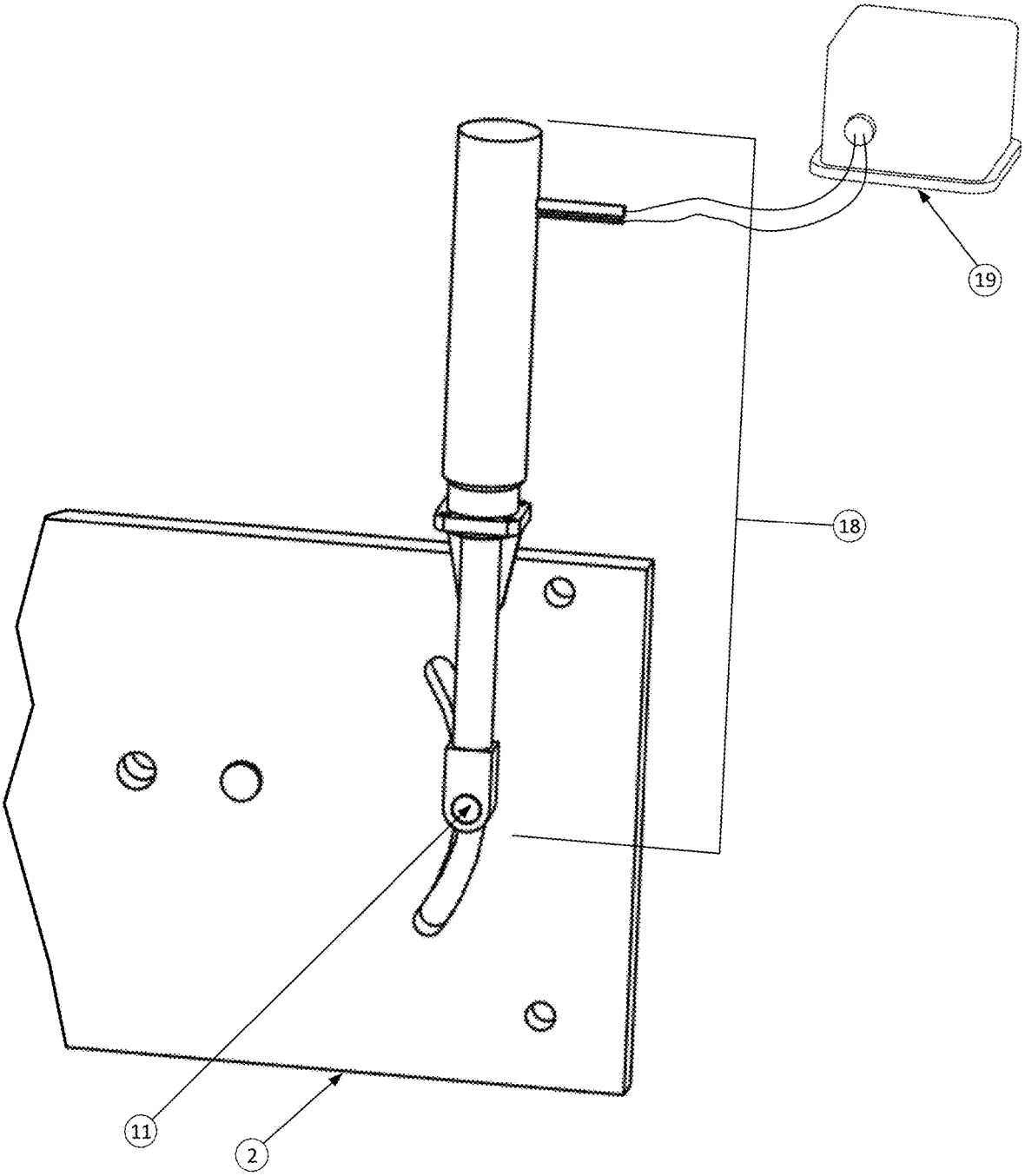
*Figure 9* – Automatic Linear Activation of the Mechanism

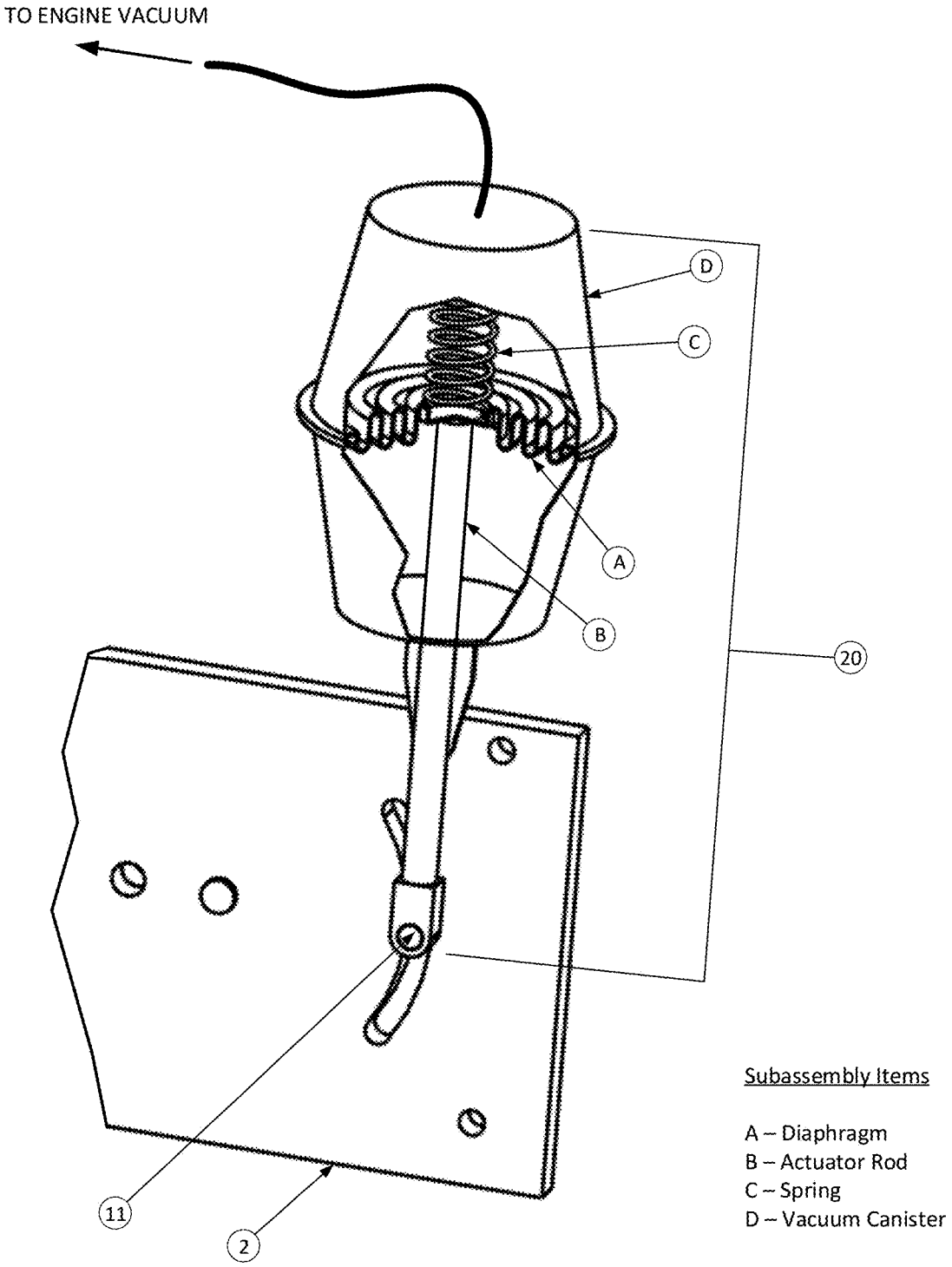
*Figure 10* – Automatic Vacuum Activation of the Mechanism

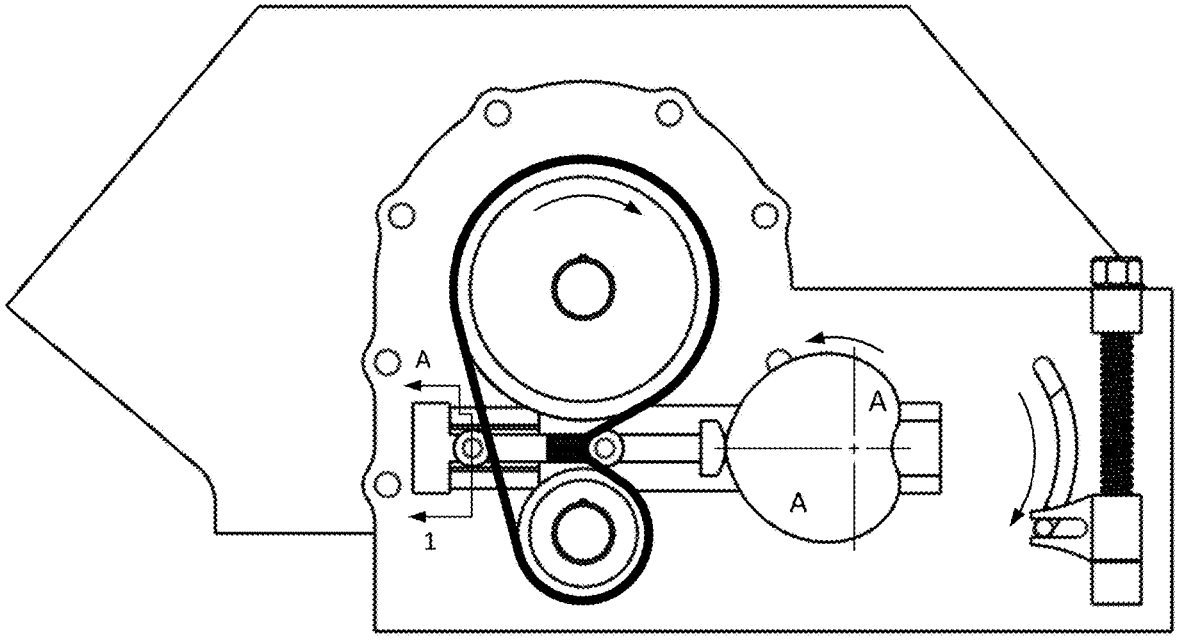
*Figure 11* – Mechanism Shown in Full Timing Advance Position
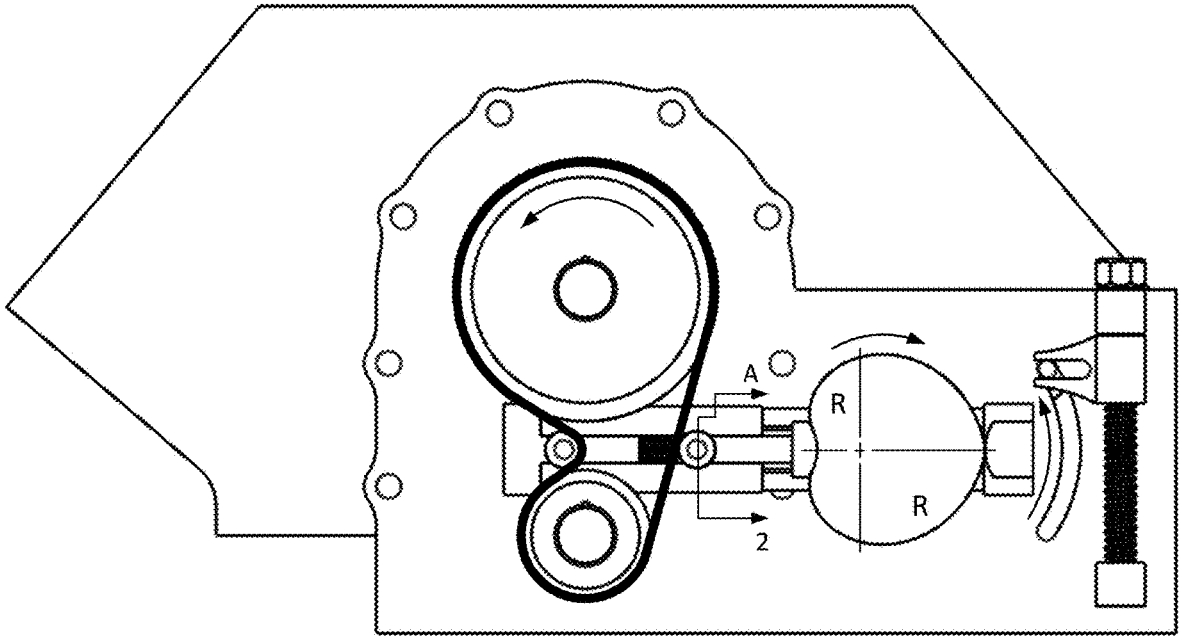
*Figure 12* – Mechanism Shown in Full Timing Retard Position

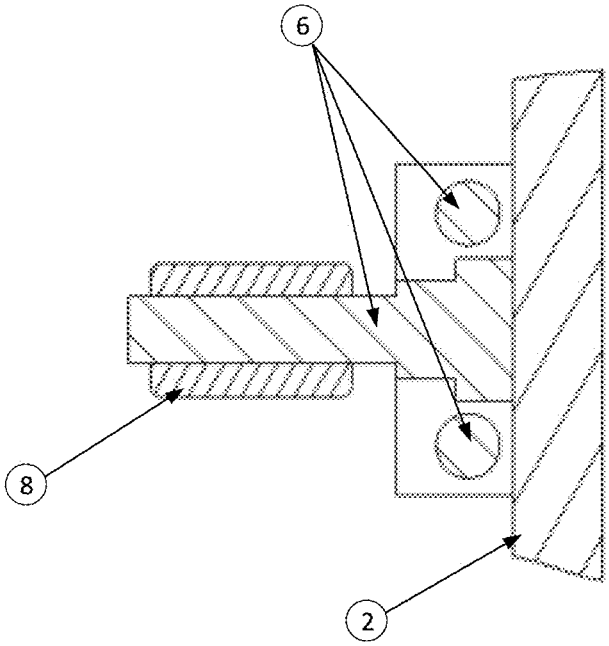
*Figure 13* – Cross Section A-1 - Slack Side Follower and Idler Roller
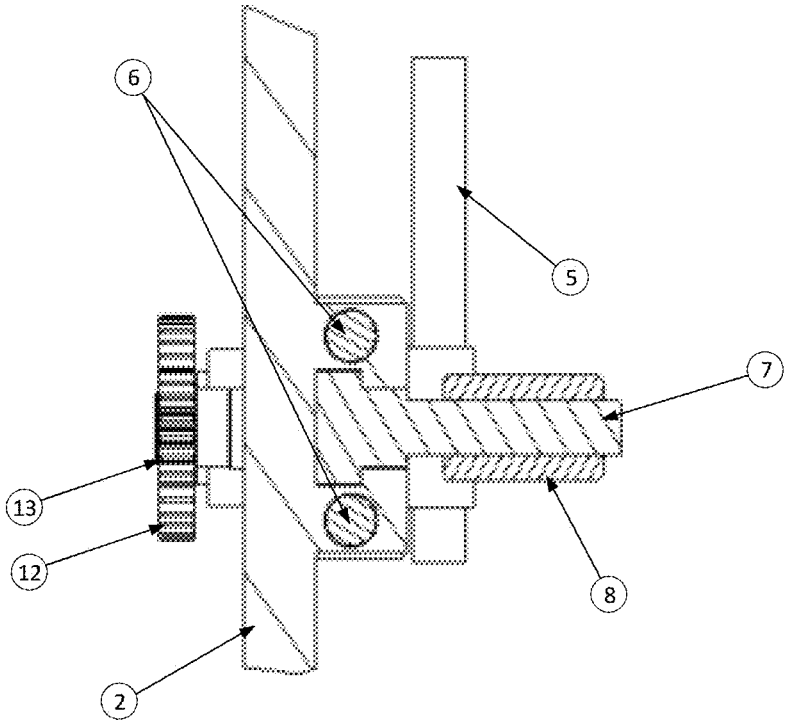
*Figure 14* – Cross Section A-2 - Tension Side Follower and Idler Roller

VARIABLE VALVE TIMING METHOD AND MECHANISM

BACKGROUND

1. Technical Field

This invention relates generally to automotive internal combustion engines, in particular high performance engines, whereby a mechanism precisely adjusts valve timing such that optimal camshaft timing may be obtained particularly where a vehicle with dual driving modes is sought. Without said mechanism the vehicle's engine may be optimally tuned for either maximum high speed performance, or optimum low speed performance, whereby these modes are mutually exclusive. Once having fit the mechanism to the engine, valve timing may be easily adjusted allowing dual driving modes to be readily obtainable. Where equipped with manual activation features, valve timing may be adjusted in advance by the operator in a convenient manner to suit the particular driving application or event. Further, by automatic activation of the mechanism directly in response to commands from the engine, optimal engine performance may be delivered while the vehicle is in operation for the entire range of driving situations employed.

2. Background Information

Background information is for informational purposes only and does not necessarily admit that subsequently mentioned information and publications are prior art. A mechanism for affecting changes in camshaft phase angle may cause the valve opening and closing events, or timing, to be advanced, or retarded, in relation to crankshaft zero angle, which occurs when the number one piston is at top dead center (TDC) of its stroke. The camshaft intake and exhaust activation profiles being fixed in relation to one another in a single camshaft engine, are not changed but are timed so as to be optimized for either low or high speed engine operation, whereby one is imposed at the sacrifice of the other. Veritably, the effect is so pronounced that early prior art deals with adjustment of the valve timing with variations in the engine operating speed to ensure that all the fuel fed to the engine is effectively utilized to produce power, as described by Hoffner in U.S. Pat. No. 1,220,124.

Contemporary prior art continues development chiefly of the means of affecting camshaft phasing as a performance enhancement having various benefits. As taught by Garcea in U.S. Pat. No. 3,721,220, especially for camshafts constructed for high performance use, there exists a portion of the valve opening profiles where the intake and exhaust valves are both partially open occurring near the time of the piston at TDC of the intake stroke. This valve opening overlap has many utilities and performance benefits generally at high speeds, but may be detrimental at low speeds. High speed performance improvement owing to the valve overlap phase is especially relevant to engines whose fluid dynamic properties of the intake and exhaust streams have been specifically optimized to exploit this inertial phenomenon.

Thus, during the valve overlap phase, advantage is taken of the low pressure scavenging effect from the exhaust gases by allowing communication of the exhaust port with the intake port, thereby improving induction with an attendant increase in power output. Further, by delaying the intake valve closing event, advantage is taken of the inertial ramming of the intake charge owing to the mass of the incoming gases at high velocity. Whereas, this co-relationship of flow dynamics and the requisite delay in valve timing may not be optimally established by theory of design, but may require fine tuning of the camshaft timing based on empirical results obtained during repeated trials. And, at low speed operation, such communication of the intake and exhaust events and delayed valve timing may cause reversion of the incoming charge harming power production. In this case, it is advantageous to advance the valve timing for low speed operation to close the intake valve sooner during the intake stroke to prevent reversion thus achieving improved engine idle, improved fuel economy, and low speed torque output. This utility being well known to someone familiar and practiced in the art, fit a mechanism to the engine prescribed herein for allowing such fine tuning and adjustment of the camshaft valve timing. Furthermore, such mechanism, by simplicity of design and adaptability may allow it to be retrofit onto an engine which originally was designed and constructed without means for variable valve timing.

Once having fit said mechanism to the engine, utilization of the mechanism may be practiced in several ways. At the most basic level, the mechanism having been fitted with a simple screw actuator acting upon the input lever, as delineated and demonstrated in the accompanying figures and drawings, would allow the operator to adjust the valve timing on a case basis to a set position which may be optimized for all further driving. Whereby such a single set point inherently requires a compromise between the optimal high and low speed settings, but may be optimized for one at the expense of the other, e.g., tuning for high speed competitive use of the engine exclusively. As stated earlier, such utility owing to the ease of use of the invention allows indefinite fine tuning of the valve timing to arrive at the optimal maximum performance value for said engine, such as would be accomplished during engine testing on an engine dynamometer specifically employed for such purposes. However, where it is desired to utilize separate high and low speed settings, individually, upon occurrence of distinctly separate driving situations, e.g. high performance competitive driving versus low speed over the road conveyance, the optimal valve timing for either may be easily preselected by the operator using the manual actuation device fitted to and exemplified in the invention. Thus, a second, more expansive use of the mechanism is exploited to allow over the road use of highly tuned engines which otherwise would not be suitable for passenger conveyance. Whereby such utility may be realized in prior art such as described in U.S. Pat. No. 4,096,836, that device requires repeated loosening and tightening of several adjuster screws and lock screws, and is not optimized for ready adjustment via a single actuation screw as exemplified in the accompanying invention. Both of these levels of utilization of the invention so described may be characterized as statically adjusting said mechanism by a manual activation device fitted to and exemplified in the invention as described herein.

Further expansion of the utility of the invention is achieved by dynamical activation of the mechanism. This may be effectuated by fitting the mechanism with an automatic actuation device such as an electronic servo motor, linear actuator, or vacuum servo actuator, any of which by suitable connection to the mechanism input lever as will be shown, may cause valve timing to be constantly adjusted in accordance with commands from a controller that senses engine operating parameters, such as crankshaft angular velocity, i.e. revolutions per minute (rpm), or directly by connection to engine vacuum which varies with engine speed and load. Once having fit the mechanism with an active actuation device and continuously sensing controller, or vacuum canister, the camshaft timing may be coordinated with the needs of the engine. As explained above, camshaft timing advance is suitable for low speed (rpm) driving modes and delay of the valve timing is optimal for high speed (rpm) mode, whereby automatic actuation of the mechanism arrives at those extremes at the end points of its travel. Continually varying valve timing is thus achieved for the range of rpm between the low and high extremes in direct proportion to the engine rpm thereby optimizing valve timing for any driving situation without operator intervention.

Much prior art comprises appurtenances fitted to the camshaft or camshaft drive system such as hydraulically operated camshaft phasers, all of which require modulation by a suitable control device in response to sensed parameters of engine operation including oil pressure, engine vacuum, or crankshaft position, all of which are direct or indirect indicators of engine rpm. The parameter so utilized for this purpose is not the object of this invention but may be selected based on ready availability or economy of design. Rather, the mechanical appurtenances physically effectuating the camshaft phasing (either manual or automatic) in accordance with and in response to said operating parameter are the object of the invention whereas being unique and novel regarding the prior art.

More specifically, prior art described in U.S. Pat. No. 3,888,217 is said to accomplish variable valve timing in response to engine commands by displacement of idler pulleys bearing against both tension and slack sides of the timing belt which is conventionally run between the crankshaft and the camshaft pulleys. Hisserich claims a displaceable yoke carrying said idler pulleys and a means to displace said yoke to vary the angular relation between the camshaft and crankshaft pulleys and thereby vary the valve timing of said engine. As shown in U.S. Pat. No. 3,888,217, such idler pulleys being fixed to a singular yoke act in equal proportion against the tension and slack sides of the belt. Further, Finlay in U.S. Pat. No. 3,496,918 presents a similar mechanism for varying valve timing comprised of symmetrically disposed idler pulleys acting on both tension and slack sides of the belt between the crankshaft and the camshaft. Again, said idler pulleys regardless of the means of activation, act equally against either side of the belt as their positions are fixed in relation to one another, both idler pulleys being mounted to a common yoke or linkage.

Object or Objects

A method and mechanism fitted to an internal combustion engine provide precise control over valve timing of the camshaft. Said mechanism comprised of oppositely disposed idler rollers, whereas not bound to a single yoke or other carrier as in prior art, so as to achieve independent movements of the rollers, which bear against both tension and slack sides of the belt between the crankshaft and camshaft pulleys causing predictable and repeatable variation in valve timing. Whereas prior art presupposes such action by symmetrically disposed idler rollers acting in equal amounts whereby being affixed to a singular yoke or carrier. As demonstrated herein, such action in prior art will cause opposite, but unequal changes in the effective free length of the belt on either side causing the mechanism to bind, the belt to break or go slack, so as to be ineffectual or imprecise in accomplishing changes in the valve timing. The object of this invention, whereby coordinated but independent movements of the idler rollers is achieved, owing to the nature of the mechanical appurtenances so described herein including a specially developed cam to actuate said idler rollers, produces precise changes in camshaft phase angle due to adjustments by the operator or in response to suitable automatic activation devices, also exemplified in the invention.

SUMMARY OF INVENTION

This invention teaches that when the camshaft pulley is rotated relative to the crankshaft pulley (i.e., camshaft phasing), unequal changes in the free length of the belt will occur on the tension and slack sides of the drive, thus, this object may only be achieved by idler rollers whose translations are non-equal to accommodate said difference. FIG. 1 illustrates a camshaft pulley having a pitch radius equal to R, and having a belt which wraps around said pulley driven by a drive pulley (not shown). Emanating from the center of the camshaft pulley is the origin of principle axes, X (horizontal) and Y (vertical). So as to simplify the problem, the drive/driven pulley system is divided about a line of symmetry along the X' axis, shown in FIG. 1. Idler rollers situated on and acting along horizontal axis X' urge the belt to wrap further around the pulley on the tension side or unwrap from the pulley on the slack side of the belt when said idler rollers are displaced from right to left as illustrated, or, to cause the opposite action when so displaced from left to right. The degree to which the belt is either wrapped or unwrapped from the pulley is defined by the angle of the belt theta, θ, being normal to the tangent of the belt at the pulley.

The camshaft pulley as shown in FIG. 1 is driven by the crankshaft in the clockwise direction by tension on the right side whereas the belt on the left side is relieved of tension and would go slack if excess length is developed therein. The action of the belt owing to the idler rollers can be described as follows, beginning with the tension idler roller fully displaced to the right toward point C, at which point having no effect on the direction of the belt, and with an angle θ equal to 90 degrees, the free length of the belt from point A to point C, $L_{AC}$, is equal to ½πR. As the idler roller on the tension side is displaced toward the left urging the belt inward, a fixed point on the belt at C will subtend an involute curve of a circle toward point B. The pitch line of the belt as it intersects the axis X' will thus grow in length by an increment equal to $\mathsf{T}$. The belt being of fixed length thus will cause rotation of the camshaft pulley, thereby affecting camshaft phasing in the advance direction in this case. The action of the free length of the belt on the slack side is opposite as the idler roller moves from the origin of the X' axis to the left toward point D. Thus to compensate for the effective lengthening of the belt on the tension side, an opposing decrease in effective free length of the belt on the slack side, i.e., decrease in Σ, must occur in exact equal proportion to the increase in belt length on the tension side so as to prevent belt breakage or to prevent the belt from developing excess slack thereby causing a loss of accurate camshaft phasing or belt disengagement.

Specifically, in prior art, the idler rollers are affixed to a common yoke and move exactly together. As such, and if displaced from right to left from initial locations at points 1 and 3, and finally to points 2 and 4, the effective change in belt tension is $\Delta\mathsf{T}(=\mathsf{T}_2-\mathsf{T}_1)$ and the slack developed is $\Delta\Sigma(=\Sigma_4-\Sigma_3)$. As can be readily seen from the diagram, owing to the highly variable change in belt length following the involute curvature, the rate of change in length of the belt on the tension side will progressively increase as the rate of decrease in length of the belt on the slack side will progressively decrease if the idler rollers move in equal increments from right to left on the diagram, thereby causing an opposing but unequal change in effective belt length, i.e., $\Delta T \neq \Delta\Sigma$. Thus, in the case of prior art, the increase in tension exceeds the amount of slack produced causing the belt to break or mechanism to bind, owing to the idler rollers translating in the exact equal amounts. Therefore, to assure balanced changes in the effective belt length on both tension and slack sides of the belt, opposite but unequal displacement of the idler rollers must occur and be calibrated such that every increment in the belt tension, $\Delta T$, is exactly equal to and opposite to every incremental decrease in belt length, $\Delta\Sigma$, on the slack side.

To accomplish this, a method and mechanism for progressively displacing said idler rollers, and acting independently of one another, must be applied to effectuate equal and opposite increments in belt tension and slack when so displaced, the net effect thereby causing camshaft phasing in either the advance or retard direction. The basis for such a mechanism is to first establish the relationship between increments, $\Delta X'$, in the tension idler roller position and the resulting change in tension, $\Delta T$, and similarly for changes in the belt slack, $\Delta\Sigma$, owing to increments, $\Delta X'$, in the position of the idler roller on the slack side. From geometrical analysis of the system shown in FIG. 1, the following relationships may be determined. The (X, Y) coordinates of points on the belt located at 1, 2, 3, and 4 may be determined as functions of angle theta, θ, based on the equation of an involute curve of a circle.

Therefore, $$X_\theta = R(\sin\theta - \theta\cos\theta)$$

$$Y_\theta = R(\cos\theta + \theta\sin\theta)$$

and by geometry, $$T_\theta = \frac{(L_{AC} - Y_\theta)}{\sin\theta}$$

inserting for $Y_\theta$ in the above, $$T_\theta = \frac{(L_{AC} - R(\cos\theta + \theta\sin\theta))}{\sin\theta}$$

and by geometry, $$X'_\theta = \frac{(R - L_{AC}\cos\theta)}{\sin\theta}$$

As both $T_\theta$ and $X'_\theta$ are functions of the belt angle theta, θ, a computational solver may be used to develop the relationship for T as a function of X', or the function $T_{X'}$. For an assumed camshaft pulley with radius R=3, values for $T_{X'}$ are then plotted with X' over the range X' equals 0 to 3. FIG. 2 shows the values so plotted. As shown, and as expected, the increment to the free length of the belt on the tension side, $T$, is non-linear, growing increasingly as the position of the idler roller, X', moves from its outermost location inward. The same relationship occurs in the opposite direction on the slack side of the belt for Σ as a function of −X'.

By computational analysis, the instantaneous slope at each point along $T_{X'}$ may be determined and plotted as the first derivative of $T_{X'}$, or $$\frac{\delta T}{\delta X'}.$$

As illustrated on FIG. 2, the plot of the derivative follows a straight line having constant slope, the value of which may be determined by regression analysis, and having done so, setting this value equal to the second derivative of $T_{X'}$, or $$\frac{\delta^2 T}{\delta X'^2}.$$

Having found this slope in the example to be equal to 0.217, it follows then that the second derivative may be integrated twice to arrive at the equation describing the relationship between T and X', i.e., the function $T_{X'}$.

thus, integrating:

$$\int \frac{\delta^2 T}{\delta X'^2} = \int 0.217$$

and this being equal to:

$$\int_{T'_o}^{T'_{X'}} \frac{\delta T'}{\delta X'} = \int_{X'_o}^{X'} 0.217\,\delta X'$$

$$T'_{X'} - T'_0 = 0.217X'|_{X'=0}^{X'=3}$$

$$0 - T'_0 = 0.217(3) - 0$$

$$T'_0 = -0.651$$

therefore:

$$T'_{X'} = 0.217X' - 0.651$$

integrating again:

$$\int_{T_0}^{T_{X'}} \frac{\delta T}{\delta X'} = \int_{X'_o}^{X'} 0.217X' - 0.651$$

$$T_{X'} - T_0 = (1/2)0.217X'^2 - 0.651X'|_{X'=0}^{X'=3}$$

$$0 - T_0 = 0.109(3)^2 - 0.651(3) - (0 - 0)$$

$$T_0 = \mathbf{-0.976}$$

therefore:

$$T_{X'} = 0.109X'^2 - 0.651X' + 0.976$$

Now, knowing the relationship between the increase in the belt length, $T_{X'}$, with each position of the idler roller, X', the goal is to determine the incremental values of X' so as to cause uniform changes in $T_{X'}$, i.e., uniform changes in belt tension. To accomplish this, a computational based iterative solver may be used to determine said values of X' for each uniform increment of $T_{X'}$. FIG. 3 shows the determined values of X' so as to cause uniform changes in the belt tension, $T_{X'}$, and by the same formulation, the values of −X' so as to cause equal and opposite changes in belt slack, $\Sigma_{X'}$. As can be seen in FIG. 3, linear increments in tension and slack are associated with non-linear changes in position X' and −X', respectively. The values of X' and −X' are shown in FIG. 3 at linear increments of cam angle, α, from 0 to 180 degrees.

This being done, the values of X' are transposed onto the profile of a cam. In effect, plot values of X' as the polar coordinates around an axis, with uniform increments of angle, α, thereby constituting the perimeter profile of a cam whereby when placed in physical contact with a suitable follower may effectuate translation in the position of an idler roller from X'=0 to R. FIG. 4 shows the plot of a cam profile having an initial radius of r=0, incremented by the values of X' from 0 to 3 for angle α from 0 to 180 degrees. The cam is placed in physical contact with a linear follower connected to an idler roller bearing on the tension side of the belt so as to urge said follower over the distance to be traversed by the tension idler roller, X'=0 to R. A counter-opposing cam having the profile on the opposite side of said cam, or a single cam having this profile symmetrically disposed on the opposite side of the cam as shown in FIG. 4, may by physical contact with a suitable follower with attached roller bearing upon the slack side of the belt, be used to thusly cause equal and opposite increments to the free length of the belt on the slack side so as to completely balance the effective increase in belt length on the tension side, ensuring that the belt does not break, bind, or go slack. Thereby effectuating precisely controlled, uniform changes in the camshaft phase angle relative to the crankshaft, so defined in FIG. 1 equal to:

$$\Delta\alpha = \Delta T_{X'}/R$$

The above-discussed exemplifications of the present invention will be described further herein below. When the word "invention" or "exemplification of the invention" is used in this specification, the word "invention" or "exemplification of the invention" includes "inventions" or "exemplifications of the invention", that is the plural of "invention" or "exemplification of the invention". By stating "invention" or "exemplification of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the accompanying drawings.

FIG. 1—Diagrammatic figure of camshaft driven pulley and belt at various angles.

FIG. 2—Plot of the increase in belt length, T, and its first derivative, as functions of X'.

FIG. 3—Plot of the linearized increase in belt length, T, and slack in the belt, Σ, with corresponding values of X' and −X', respectively, as functions of cam angle, α.

FIG. 4—Plot of polar coordinates for X' and −X', expressed as the cam radius, r, with cam angle α.

FIG. 5—Isometric view of backing plate and appurtenances mounted to engine block.

FIG. 6—Rear view of backing plate showing cam actuation lever and gears.

FIG. 7—Exploded view of mechanism and backing plate; engine block and drive pulleys not shown.

FIG. 8—Cutaway view showing automatic rotatory actuator device attached to the leadscrew; cam and followers not shown for clarity.

FIG. 9—Cutaway view showing automatic linear actuator device attached directly to the lever; cam and followers not shown for clarity.

FIG. 10—Cutaway view showing automatic vacuum actuator device attached directly to the lever; cam and followers not shown for clarity.

FIG. 11—Front view showing cam and followers in the full timing advance position and the effective pitch line of the belt.

FIG. 12—Front view showing cam and followers in the full timing retard position and the effective pitch line of the belt.

FIG. 13—Cross section A-1 of the slack side roller and follower within the track of the backing plate.

FIG. 14—Cross section A-2 of the tension side roller and follower within the track of the backing plate.

DESCRIPTION OF EXEMPLIFICATION OR EXEMPLIFICATIONS

Figure Reference Numerals

1 Engine Block
2 Backing Plate
3 Crankshaft Pulley
4 Camshaft Pulley
5 Cam
6 Slack Side Cam Follower
7 Tension Side Cam Follower
8 Idler Rollers
9 Timing Belt
10 Spring
11 Cam Actuator Lever
12 Actuator Lever Gear
13 Cam Pinion Gear
14 Bearing Blocks
15 Leadscrew Follower Nut
16 Leadscrew
17 Rotary Servo Actuator
18 Linear Servo Actuator
19 Programmable Controller
20 Vacuum Servo Actuator FIG. 5 is an isometric illustration of an exemplification of the invention whereby a system of mechanical appurtenances arranged against a backing plate, item 2, are affixed to an engine block, item 1, by attachment of said backing plate. The backing plate is interposed between engine block and camshaft drive system containing the crankshaft drive pulley, item 3, and camshaft driven pulley, item 4. The existing camshaft is driven by a timing belt, item 9. The path of the timing belt on both the tension side, right hand side, and the slack side, left hand side, is directed by two idler rollers, items 8, connected individually by linkages, items 6 and 7, which bear against a cam, item 5, as in cam followers. The idler rollers are urged into contact with each side of the timing belt so as to be simultaneously adjusted by movements of the cam. A spring, item 10, is situated between the followers providing a resistive force to movement of the followers so as to maintain them in contact against the cam.

Lateral translation of the tension and slack side followers, and thus the idler rollers, is caused by rotation of the cam, item 5, through suitable means, as in actuation by a lever, item 11, connected to gears, items 12 and 13, illustrated in FIG. 6. Any suitable means whereby causing activation of the lever, item 11, to follow along an arc, such as by manual force causing vertical translation of the leadscrew nut, item 15, which bears upon the lever, item 11, causing it to pivot along the arc carved out in the backing plate, item 2, as shown in FIG. 5. In this case the leadscrew nut, item 15, is activated and follows by threaded engagement with the leadscrew, item 16, which is manually rotated in this case. For further clarity, FIG. 7 shows the details of the mechanism in exploded view. It logically follows then that automatic activation of the cam, item 5, and followers, items 6 and 7, could be effectuated by fitting any suitable remote actuation device to act upon the lever, item 11, either by rotation of the leadscrew, item 16, by rotatory servo device, an example for which is shown as item 17 in FIG. 8, or acting directly upon the lever, item 11, by linear actuation device in lieu of the leadscrew, item 16 and leadscrew nut item 15, an example for which is shown as item 18 in FIG. 9.

Where a suitable electro-mechanical device is mounted to the mechanism to cause activation of the lever, item 11, as shown in FIGS. 8 and 9, a programmable controller is thus required to electronically signal the device to actuate in response to said engine parameter(s) being sensed by the controller, thereby causing modulation of the variable valve timing mechanism. Such a controller, item 19, may be utilized to monitor any such parameter that is indicative of engine rpm. In a simple adaptation the controller thus could be equipped with an electrical induction pickup placed around the number one cylinder spark plug wire, as is normally practiced when utilizing a conventional ignition timing light, so as to provide one impulse per every combustion cycle. From the frequency of this parameter thus determined by the controller, engine rpm may be directly inferred. The controller then may command the electronic actuator, item 17 or 18, to adjust the position of the valve timing, as effectuated by adjustment to the position of the lever, item 11, as previously discussed.

Another means to synchronize the movement of the cam directly with the speed of the engine, not relying upon electronic control devices, is to actuate the lever, item 11, directly in response to changes in engine vacuum. This method is very reliable as it is purely mechanical in nature. As it is well known that engine vacuum is a ready and reliable source of motive power, whereby having been used for decades to activate several of the vehicles accessories and other engine control devices such as and including: windshield wipers, fuel pumps, ventilation system dampers, and engine ignition timing advance mechanisms. In such cases, the source of the engine vacuum in the intake portion of the manifold or carburetor is connected via hose or other plumbing to a vacuum servo canister which typically includes an actuation rod that is extended or retracted in response to changes in the vacuum so as to actuate said accessories. In these cases, either manifold vacuum is used directly, or a specifically placed port in the carburetor is used to obtain venturi vacuum. In the latter case, venturi vacuum is an ideal source of vacuum where it is sought to modulate the connected device directly with engine speed, i.e., increase vacuum linearly with engine speed. It is well known from the Bernoulli principle that the magnitude of the vacuum at the venturi port will increase directly with total air mass flow fed through the engine which varies directly in response to the speed of the engine. Whereas manifold vacuum is greatest at low speeds and may reduce to nothing at higher engine speed; and thus, is not well suited for this application. Therefore, attach a typical vacuum servo actuator, as exemplified by item 20 in FIG. 10, directly to the cam actuation lever, item 11, whereby being connected to a venturi vacuum port, said vacuum canister will retract upon increasing engine rpm thus causing an upward motion of the lever, in this case, causing valve timing retard which is desired at higher engine speeds. Upon decreasing engine speed, with directly decreasing venturi vacuum, the vacuum canister extends under the urging of the return spring, to allow the lever to translate downward thus causing advancement in the valve timing which is desired at low engine speed.

And yet another means to automatically actuate the variable valve timing mechanism is by expansion of the inputs to the electronic programmable controller to monitor both engine speed and engine manifold vacuum; engine manifold vacuum is a reliable indicator of throttle position, which in turn correlates to the load placed on the engine by the operator. Therefore, a logic controller already exemplified by item 19 in FIGS. 8 and 9, may sense both these parameters indicative of engine speed and load and respond to effectuate the predetermined desired valve timing set point for said conditions.

In FIG. 5 the cam, item 5, is shown in the neutral position whereby both sides of the timing belt ascribe equal free lengths so as to cause neither advancement nor retardation of camshaft phasing. In FIG. 11, the cam is shown rotated (90 degrees counterclockwise) to the fully advanced camshaft phasing position resulting in a relative increase in the free length of the belt on the tension side which is balanced by an equal and opposite decrease in effective belt length on the slack side. Referring to FIG. 3, the relative length changes in both tension, $\Delta T$, and slack, $\Delta\Sigma$, of the belt are balanced during this transition from the neutral position to the advanced position owing to the perimeter profiles, FIG. 4, on opposite quadrants of the cam, item 5, which act simultaneously but independently on each of the slack side cam follower, item 6, and the tension side cam follower, item 7. Thereby effectuating precise incremental changes in the camshaft phasing while ensuring that the timing belt is neither over tightened nor allowed to go slack. To demarcate the portion of the cam profile transited by the followers in this case, the advance quadrants are labeled "A" in FIG. 11. The same is true during actuation between the neutral and fully retarded position of the camshaft, FIG. 12, by rotation of the cam (90 degrees clockwise) from the neutral position, with the tension and slack side followers transiting cam quadrants labeled "R" in this case. In either case of activation of the cam, item 5, from the neutral position to the advanced, FIG. 11, or retarded, FIG. 12, position it is understood that said transition is effectuated by a rotation of the leadscrew, item 16, causing the nut, item 15, to move down in the case of advance thus acting on the lever, item 11, or move up in the case of retardation thus acting in the opposite direction on the lever, item 11.

FIG. 13 shows the cross sectional view A-1 through the projecting shaft of the slack side idler roller which is integral with the slack side follower, item 6. As shown, the follower is retained by L-shaped rails projecting from the backing plate, item 2. The rails guide the follower along its path of translation. The slack side follower includes integral circular guide rods which extend from the far extent of the follower on the slack side of the belt (left side) to the far end of the follower adjacent to the cam, item 5, on the right. FIG. 14 shows the cross sectional view A-2 through the projecting shaft of the tension side idler roller which is integral with the tension side follower, item 7. The tension side follower is similarly retained and rides within the L-shaped guide rails contiguous to the backing plate, item 2.

Exemplifications of the invention so illustrated may derive from the method of development presented herein by someone skilled in the art and with knowledge of the method so described, such that the scope of the invention shall not be limited to exemplifications comprised herein but shall comprise any such mechanism causing by mechanical means uniform changes in the effective free length of the belt ascribed on both of each tension and slack sides owing to dis-uniform movements of idler rollers, items 8, bearing on both of said sides of the belt. The movements of the idler rollers on either side of the belt being coordinated but independent so as to cause equal and opposite changes in the effective free lengths of the belt on either side. Such movement of each of both idler rollers may be effectuated by a single cam, item 5, so developed as to have progressive profiles symmetrically disposed on either of its sides so as to urge the individual idler roller on either side of the belt into increments of translation progressively increasing and decreasing, respectively, on opposite sides of the belt. Or individual cams having said profile over half of their perimeters may be situated so as to individually act on each of both tension and slack sides of the belt in coordination with each other, whereby said cams are connected by a linkage or mechanism.

The preferred exemplification having a single cam, item 5, through its rotation, caused by a suitable device such as a lever, item 11 connected through gears, items 12 and 13, to a leadscrew, item 16, and follower nut, item 15, actuated by manual or automatic rotation of the leadscrew being exemplified in the invention, but not constrained to any individual style or construction, causes movement of a tension side follower, item 7, bearing on one side of the cam, item 5, whilst causing movement of a slack side follower, item 6, bearing on the opposite side of the cam. Each of said followers is fitted with an idler roller, item 8, which bears against the outside of the belt on either side of the camshaft drive system. Rotation of the cam, item 5, thus causes the followers, and affixed idler rollers, to move in the same direction, but in unequal amounts owing to the followers transiting the counter-opposing quadrants of the cam profile being asymmetrical over said quadrants as shown in FIGS. 11 and 12.

A spring, item 10, is situated between the followers providing a resistive force to movement of the followers so as to maintain them in contact against the cam, item 5.

The movements of the idler rollers, item 8, on each of their respective sides of the belt are coordinated and controlled according to the precise profile machined onto the perimeter of the cam, item 5, according to the progressive relationship previously determined, as described above, and thusly illustrated in FIGS. 1, 2, 3, and 4. The followers, items 6 and 7, translate due to the urging of the cam, item 5, from right to left, or left to right, and as illustrated in FIG. 3, translate in non-uniform increments of X' or −X' with uniform increments of cam rotation, thereby causing uniform and counter-acting changes in belt tension, T , and belt slack, Σ, as delineated in FIG. 3, so as to cause balanced changes in the tension and slack lengths of the belt, which in turn causes camshaft phasing.

More summarily, a method and mechanism for remotely adjusting the timing of valve opening and closing events in reciprocating internal combustion engines having a camshaft contained within the engine block. A pair of idler rollers, fixtured so as to be oppositely disposed about the center plane between the camshaft and crankshaft pulleys, that may be simultaneously offset in either direction, but acting in accordance with independent and continuously varying displacement patterns, so as to cause counter-opposing, but equal, deviations in the free length of the camshaft drive belt in each of both tension and slack sides of the belt thus causing a controlled change in angular relation between the camshaft and crankshaft, known as camshaft phasing. The idler rollers each being affixed to independent linkages are activated by a cam with precisely machined profile around its perimeter so as to cause translation of the rollers against each side of the belt according to the pre-determined pattern of the cam profile. The resulting lengthening of the path of the belt on one side, being equal to the shortening of the path of the belt on the opposite side, so as to not cause the belt to break, bind, or go slack, causes camshaft phasing which is beneficial to the operation of the vehicle and may be caused by manual actuation by the operator, or automatically by commands from the engine to a suitable actuator acting on the cam.

One feature or aspect of an exemplification is believed at the time of the filing of this patent application to possibly reside broadly in a variable valve timing method for internal combustion engines comprising appurtenances of the class described, in combination with an internal combustion engine containing a camshaft so driven by a belt, chain, or other flexible band capable of transmitting motion from a drive wheel to a driven wheel without slipping, and as to be affected by idler rollers not connected to a common yoke or carrier acting independently against the belt causing equal and opposite changes in the effective free length of the belt on each of both tension and slack sides of the belt, thus, causing a relative change in angle between the drive and driven wheels or pulleys so as to advance or retard the angle of the camshaft in relation to the crankshaft.

Another feature or aspect of an exemplification is believed at the time of the filing of this patent application to possibly reside broadly in said idler rollers acting in coordination with each other, and translating in the same direction but not connected, whose motions follow independent and progressively varying patterns in relation to one another having been pre-determined so as to cause exactly equal and opposite changes in the counter-opposed tension and slack developed in the belt over the entire range of motion of said rollers.

Yet another feature or aspect of an exemplification is believed at the time of the filing of this patent application to possibly reside broadly in the path of the belt whereby being directed by idler rollers bearing against each side of the belt causing the belt to further wrap or unwrap from the pulley; on either side of the drive system, the change in effective free length of the belt thus being defined by the deviation of a point on the belt, which follows the path described as an involute curve of a circle, thereby causing a non-uniform increase in tension on one side and a non-uniform decrease in tension on the other side in response to uniform translations of the rollers, and vice versa.

Still another feature or aspect of an exemplification is believed at the time of the filing of this patent application to possibly reside broadly in knowing the coordinates of an involute curve of a circle, the change in free length of the belt as the belt either further wraps or unwraps from the pulley, respectively, on either side is determined as a variable of the increment to the position of each idler roller; the relationship once known, allowing the rollers to be displaced independent of each other by non-uniform predetermined amounts so as to maintain the increase in tension on one side exactly equal to the increase in slack on the opposing side.

A further feature or aspect of an exemplification is believed at the time of the filing of this patent application to possibly reside broadly in the linearized increments of the change in tension on one side of the belt, and change in slack on the other side of the belt, having thus been determined and effectuated by non-linear increments to the positions of the idler rollers bearing on each side of the belt so as to not cause the belt to be over tensioned, to go slack, or bind the mechanism.

Another feature or aspect of an exemplification is believed at the time of the filing of this patent application to possibly reside broadly in the known increments to the position of the idler rollers in relation to one another whereby being transposed upon the face of a cam or cams placed in communication with the idler rollers so as to effectuate their displacement.

Yet another feature or aspect of an exemplification is believed at the time of the filing of this patent application to possibly reside broadly in that the phase angle of the driven camshaft pulley in relation to the drive pulley of the crankshaft is varied by an amount related directly to the change in the free length of the belt being equal and opposite on either side of the belt, thus causing controlled changes to camshaft phase angle.

Still another feature or aspect of an exemplification is believed at the time of the filing of this patent application to possibly reside broadly in a mechanism whereby a backing plate mounted to an engine block contains a pair of linkages or followers bearing against a cam so as to be displaced by rotation of the cam; the followers have affixed at one end idler rollers which bear against either side of the belt between the crankshaft and camshaft pulleys; the followers being guided by a track or rail, act along a common axis but bear against opposite sides of the cam which comprises a precisely machined profile about its perimeter so as to cause coordinated but non-uniform displacement of the idler rollers, thus causing equal and opposite changes in the free length of the belt on either side of the drive line thus effectuating controlled changes in the camshaft phase angle.

A further feature or aspect of an exemplification is believed at the time of the filing of this patent application to possibly reside broadly in the followers acting along a common axis bearing against opposing sides of a cam so as to be actuated by transiting counter-opposing quadrants of said cam during rotation of the cam from the neutral position to the advanced or retarded position, the profiles on counter-opposing quadrants of the cam being asymmetrical so as to cause non-equal movements to the followers.

Another feature or aspect of an exemplification is believed at the time of the filing of this patent application to possibly reside broadly in the appurtenances of the backing plate mounted to the engine block including a lever and gears to activate the cam into rotation thus bearing against the followers and urging their connected idler rollers into increasing contact with the belt on one side of the drive line and decreasing contact with the belt on the opposite side of the drive line, and vice versa.

Yet another feature or aspect of an exemplification is believed at the time of the filing of this patent application to possibly reside broadly in an actuator of suitable construction and ability connected to the lever so as to cause displacement of the lever causing rotation of the cam, whereby said actuator may be manually controlled or be designed to automatically respond to commands from the engine such as in response to changes in engine speed and load; said actuator may operate by any means so as to cause force output and translation transmitting to the lever.

The components disclosed in the patents, patent applications, patent publications, and other documents disclosed or incorporated by reference herein, may possibly be used in possible exemplifications of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one exemplification of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various exemplifications may be used with at least one exemplification or all of the exemplifications, if more than one exemplification is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications, patent publications, and other documents cited herein, and in the Declaration attached hereto, are hereby incorporated by reference as if set forth in their entirety herein except for the exceptions indicated herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, patent applications, patent publications, and other documents which are included in this application and which are referred to in paragraphs which state "Some examples of . . . which may possibly be used in at least one possible exemplification of the present application . . . " may possibly not be used or useable in any one or more exemplifications of the application.

The sentence immediately above relates to patents, patent applications, patent publications, and other documents either incorporated by reference or not incorporated by reference.

All of the references and documents cited in any of the patents, patent applications, patent publications, and other documents cited herein, except for the exceptions indicated herein, are hereby incorporated by reference as if set forth in their entirety herein except for the exceptions indicated herein. All of the patents, patent applications, patent publications, and other documents cited herein, referred to in the immediately preceding sentence, include all of the patents, patent applications, patent publications, and other documents cited anywhere in the present application.

Words relating to the opinions and judgments of the author of all patents, patent applications, patent publications, and other documents cited herein and not directly relating to the technical details of the description of the exemplifications therein are not incorporated by reference.

The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more exemplifications of the patents, patent applications, patent publications, and other documents, are not considered to be incorporated by reference herein for any of the patents, patent applications, patent publications, and other documents cited herein.

The description of the exemplification or exemplifications is believed, at the time of the filing of this patent application, to adequately describe the exemplification or exemplifications of this patent application. However, portions of the description of the exemplification or exemplifications may not be completely applicable to the claims as originally filed in this patent application, as amended during prosecution of this patent application, and as ultimately allowed in any patent issuing from this patent application. Therefore, any statements made relating to the exemplification or exemplifications are not intended to limit the claims in any manner and should not be interpreted as limiting the claims in any manner.

The details in the patents, patent applications, patent publications, and other documents cited herein may be considered to be incorporable, at applicant's option, into the claims during prosecution as further limitations in the claims to patentably distinguish any amended claims from any applied prior art.

While various aspects and exemplifications have been disclosed herein, other aspects and exemplifications are contemplated. The various aspects and exemplifications disclosed herein are for purposes of illustration and not intended to be limiting. Additionally, the words "including," "having," and variants thereof (e.g., "includes" and "has") as used herein, including the claims, shall be open-ended and have the same meaning as the word "comprising" and variants thereof (e.g., "comprise" and "comprises").

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the exemplification or exemplifications, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. § 1.72(b). As stated in 37 C.F.R. § 1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The exemplifications of the invention described herein above in the context of the preferred exemplifications are not to be taken as limiting the exemplifications of the invention to all of the provided details thereof, since modifications and variations thereof may be made without departing from the spirit and scope of the exemplifications of the invention.

LIST OF REFERENCES

U. S. Patent Documents

| | | |
|---|---|---|
| 1,061,098 | May 1913 | McKeen |
| 1,220,124 | March 1917 | Hoffner |
| 1,632,223 | June 1927 | Fey |
| 2,305,787 | December 1942 | Kales |
| 2,682,260 | June 2954 | Lantz |
| 2,839,036 | June 1958 | Strang |
| 2,890,594 | June 1959 | Galonska |
| 2,969,051 | January 1961 | Webster |
| 2,980,089 | April 1961 | Sampietro |
| 3,441,009 | April 1969 | Rafanelli |
| 3,481,314 | December 1969 | LeCrenn |
| 3,496,918 | February 1970 | Finlay |
| 3,721,220 | March 1973 | Garcea |
| 3,888,217 | June 1975 | Hisserich |
| 4,096,836 | June 1978 | Kopich |
| 7,228,829 | June 2007 | Louie |

What is claimed is:

1. A variable valve timing (VVT) mechanism for an internal combustion engine including a camshaft and a crankshaft disposed in an engine block, whereby a driven pulley of the camshaft is driven by a drive pulley of the crankshaft via a flexible band, the VVT mechanism comprising:

a backing plate mounted to the engine block, the backing plate including through-openings configured to receive the camshaft and the crankshaft such that the backing plate is interposed between the engine block and the driven and drive pulleys;

a cardioid cam rotatably coupled to the backing plate, the cardioid cam configured to be selectively rotated via an actuator assembly;

a guide track integrally formed on the backing plate, the guide track defining a linear translation path extending horizontally between the driven pulley and the drive pulley;

a first linkage disposed in the guide track, the first linkage including:

a first end defining a first follower configured to engage a first lateral side of the cardioid cam, and a second end defining a first idler roller configured to engage an outer surface of the flexible band on an advance side of the driven pulley; and a second linkage disposed in the guide track, the second linkage including:

a first end defining a second follower configured to engage an opposing second lateral side of the cardioid cam, and a second end defining a second idler roller configured to engage the outer surface of the flexible band on a retard side of the driven pulley, wherein the first and second linkages translate along the translation path asymmetrically with respect to each other based on a contour of the cardioid cam as the cardioid cam rotates, wherein the first and second idler rollers act on the flexible band in accordance with a respective position of the first and second followers so as to adjust a phase angle of the camshaft with respect to the crankshaft, and wherein the flexible band is one of a belt or a chain.

2. The VVT mechanism of claim 1, wherein a rotation of the cardioid cam in a first direction advances the phase angle and a rotation of the cardioid cam in a second direction retards the phase angle.

3. The VVT mechanism of claim 1, wherein a shape of the contour is based on a first path of a first point on the flexible band between the driven pulley and the first idler roller, and a second path of a second point on the flexible band between the driven pulley and the second idler roller, when the driven pulley is adjusted from a neutral zero phase angle position to a maximum phase angle position, and wherein the second point is a symmetrical counterpoint of the first point when the driven pulley is in the zero phase angle position.

4. The VVT mechanism of claim 3, wherein the first path and the second path follow respective involute curves such that, as the driven pulley is adjusted away from the zero phase angle position, a change in a distance from the first point to the first idler roller is equal and opposite to a change in a distance from the second point to the second idler roller.

5. The VVT mechanism of claim 1, wherein the contour is evenly partitioned such that, as the cardioid cam rotates, the first follower remains in continuous engagement with a first half of the contour and the second follower remains in continuous engagement with a second half of the contour.

6. The VVT mechanism of claim 5, wherein the contour is shaped such that:

when the driven pulley is adjusted to a phase angle position that is advanced of a neutral zero phase angle position, a lateral distance traveled by the second idler roller is greater than a lateral distance traveled by the first idler roller, and when the driven pulley is adjusted to a phase angle position that is retarded from the zero phase angle position, the lateral distance traveled by the first idler roller is greater than the lateral distance traveled by the second idler roller.

7. The VVT mechanism of claim 1, further comprising a spring disposed in the guide track between the first linkage and the second linkage, the spring configured to urge the first and second followers towards the cardioid cam.

8. The VVT mechanism of claim 1, wherein the actuator assembly comprises a lever rotatably coupled to the backing plate, the lever including:

a first end defining a pin configured to travel within a curved slot in the backing plate, and a second end defining an axis of rotation and a lever gear configured to engage a pinion gear of the cardioid cam, wherein the cardioid cam rotates when the first end of the lever is moved along the curved slot.

9. The VVT mechanism of claim 8, wherein the actuator assembly further comprises:

A servo actuator configured to move the first end of the lever, and

A programmable controller configured to control the servo actuator based on engine operating parameters.

10. The VVT mechanism of claim 9, wherein the servo actuator is a rotary servo actuator.

11. The VVT mechanism of claim 9, wherein the servo actuator is a linear servo actuator.

12. The VVT mechanism of claim 8, wherein the actuator assembly further comprises a vacuum servo actuator configured to move the first end of the lever based on engine vacuum.

* * * * *